US008616112B2

(12) United States Patent
Herrmann et al.

(10) Patent No.: US 8,616,112 B2
(45) Date of Patent: Dec. 31, 2013

(54) BREECH DRIVE FOR A WEAPON

(75) Inventors: Ralf-Joachim Herrmann, Senzig (DE); Heiner Schmees, Celle (DE); Berthold Baumann, Eschede (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 210 days.

(21) Appl. No.: 13/154,235

(22) Filed: Jun. 6, 2011

(65) Prior Publication Data

US 2012/0132062 A1 May 31, 2012

Related U.S. Application Data

(63) Continuation-in-part of application No. PCT/EP2009/007974, filed on Nov. 7, 2009.

(30) Foreign Application Priority Data

Dec. 4, 2008 (DE) ..... 10 2008 060 217

(51) Int. Cl.
*F41A 3/12* (2006.01)

(52) U.S. Cl.
USPC ..... 89/20.4; 89/45

(58) Field of Classification Search
USPC ..... 89/17, 19, 20.2, 20.4, 45, 47, 11
See application file for complete search history.

(56) References Cited

U.S. PATENT DOCUMENTS 430,206 A 6/1890 Garland
475,276 A 5/1892 Garland
1,424,751 A 8/1922 Bangerter
2,378,191 A 6/1945 Corte
2,604,820 A 7/1952 Schiff
3,501,998 A 3/1970 Dardick
3,503,300 A 3/1970 Dardick (Continued)

FOREIGN PATENT DOCUMENTS

CH 675 767 A5 10/1990
DE 70 863 C 9/1893

(Continued)

OTHER PUBLICATIONS

Notice of Allowance issued in co-pending related U.S. Appl. No. 13/154,108 on Nov. 19, 2012.

(Continued)

*Primary Examiner* — Jonathan C Weber
(74) *Attorney, Agent, or Firm* — Griffin & Szipl, P.C.

(57) ABSTRACT

A drive for a weapon is provided, wherein rotational motion of a motor is converted to a forward or reverse motion of the breech in a simple manner using the Scotch yoke principle. In order to allow rest periods of the breech in the end positions, the crank radius is defined by a control cam, which changes when the crank is rotated. The hinge pin of the crank may be externally driven via a pinion shaft. A yoke pin is arranged in a groove of the crank so as to be radially displaceable and carries the breech carrier or the breech in a groove extending transversely to the direction of fire via a sliding block. Two rollers are arranged on the crank pin and run in control cams in the weapon or crank housing. The control cam is subdivided into different sectors/sections, thereby achieving the desired motion of the breech.

20 Claims, 3 Drawing Sheets

(56) References Cited

U.S. PATENT DOCUMENTS

| | | | | |
|---|---|---|---|---|
| 3,648,561 | A * | 3/1972 | Stoner | 89/11 |
| 3,834,272 | A | 9/1974 | Patenaude et al. | |
| 4,154,142 | A * | 5/1979 | Schwegler | 89/11 |
| 4,301,709 | A | 11/1981 | Bohorquez et al. | |
| 4,481,858 | A | 11/1984 | Price | |
| 4,563,936 | A | 1/1986 | Cleary et al. | |
| 4,686,886 | A | 8/1987 | Caserza et al. | |
| 5,134,922 | A | 8/1992 | Menges et al. | |
| 5,353,678 | A | 10/1994 | Rochelle et al. | |
| 6,009,791 | A | 1/2000 | Medlin | |
| 2011/0290103 | A1 * | 12/2011 | Herrmann et al. | 89/18 |
| 2011/0314996 | A1 | 12/2011 | Herrmann | |
| 2012/0132061 | A1 * | 5/2012 | Herrmann et al. | 89/17 |

FOREIGN PATENT DOCUMENTS

| | | | |
|---|---|---|---|
| DE | 30 21 200 | A1 | 12/1980 |
| DE | 32 16 813 | A1 | 11/1983 |
| DE | 32 18 550 | A1 | 11/1983 |
| DE | 37 12 905 | A1 | 11/1988 |
| DE | 36 27 361 | C1 | 4/1992 |
| DE | 10 2006 022 622 | A1 | 11/2007 |
| DE | 10 2007 048 468 | A1 | 4/2009 |
| DE | 10 2007 048 470 | A1 | 4/2009 |
| DE | 10 2005 045 824 | B3 | 5/2009 |
| DE | 10 2007 054 470 | A1 | 5/2009 |
| EP | 1 767 891 | A1 | 3/2007 |
| FR | 538 190 | A | 6/1922 |
| GB | 577 338 | | 5/1946 |
| JP | 6-159991 | | 6/1994 |
| JP | 7-139 896 | A | 6/1995 |
| JP | 7-174491 | A | 7/1995 |
| WO | 2009/049723 | A1 | 4/2009 |
| WO | 2009/062585 | A1 | 5/2009 |

OTHER PUBLICATIONS

International Search Report issued in related International Application No. PCT/EP2009/07975, completed Jan. 29, 2010 and mailed Feb. 10, 2010.

M242 Bushmaster, from Wikipedia, the free encyclopedia; http:/en.wikipedia.org/wiki/M242_Bushmaster, downloaded May 24, 2011.

International Search Report issued in related International Application No. PCT/EP2009/007976, completed Jan. 29, 2010, mailed Feb. 9, 2010.

International Search Report issued in related International Application No. PCT/EP2009/007977, completed Jan. 29, 2010, mailed Feb. 10, 2010.

International Search Report, International Application No. PCT/EP2009/07974, completed Jan. 29, 2010 and mailed Feb. 10, 2010.

http://www.knightswoodsecondary.org.uk/personal/Resources/Hillhead/Credit_Worksheets/CompositeAreas.pdf; downloaded May 29, 2011.

Notice of Allowance mailed Dec. 26, 2012 in co-pending related U.S. Appl. No. 13/154,170.

Notice of Allowance issued in co-pending related U.S. Appl. No. 13/153,240 on Mar. 7, 2013.

* cited by examiner

BREECH DRIVE FOR A WEAPON

This is a Continuation-in-Part Application in the United States of International Patent Application No. PCT/EP2009/007974 filed Nov. 7, 2009, which claims priority on German Patent Application No. DE 10 2008 060 217.5, filed Dec. 4, 2008. The entire disclosures of the above patent applications are hereby incorporated by reference.

FIELD OF THE INVENTION

The invention relates to drive kinematics provided with a Scotch-yoke crank drive for a feed, in particular, a linear feed, of a breech or of a cartridge into a weapon barrel.

BACKGROUND OF THE INVENTION

In externally powered machine guns, the energy for driving the weapon is not obtained from a gas pressure or from weapon recoil of the weapon, but is provided by an electrical or hydraulic drive. Particularly in the case of electrically driven weapons, the rotary movement of the motor must, for this purpose, be converted to an oscillating movement of the breech. Furthermore, the breech requires times for which it is stationary at the front and rear limit positions of its displacement movement. In a first limit position, the case pertains to wherein the previous round must be removed in front of the breech, and a new cartridge must be fed in front of the breech, before the cartridge is driven into the cartridge chamber of the weapon barrel. In a further limit position, the breech must be locked and the cartridge fired. Once the gas pressure in the weapon barrel has fallen, the breech can then be unlocked.

A rigidly locked linear breech for an externally driven machine gun has been published in DE 36 27 361 C1. A control roll is also proposed by this disclosure, to provide space-saving locking, without bouncing.

DE 37 12 905 A1 describes a machine gun which, inter alia, has a cam drum that is operated by an external drive and is used for linear movement of a linear breech. The cam drum correspondingly has a control cam that runs endlessly over the circumference. Furthermore, a short radially acting control cam and a longer axially acting control cam are arranged on the circumference.

DE 10 2005 045 824 A1 proposes a physically small weapon whose control roll is integrated on the plane of the barrel bore axis. The control roll has a control body to which at least two control cams are fitted. In this case, the cam information is converted to a linear feed of the breech.

From DE 10 2007 048 468.4, which was not published earlier than the earliest priority date for the present application, a drive is preferred for linear feeding of a breech, or of the ammunition, into a weapon barrel or a cartridge camber by means of a chain. In contrast to the bushmaster drive, in which a chain is passed over four sprocket wheels, in the form of a rectangle, and by means of which the stationary times of the breech are defined, the chain is, in this case, itself passed tightly around two sprocket wheels in a simple manner. A chain link or a stud on the chain is integrated in a guide, or groove, which is located under the movable slide. This allows the chain to continue to run during the times when the weapon is stationary, wherein these stationary times are defined by a separate function control means. The chain itself can be driven by an electric motor. A rapid stopping means is, in this case, integrated in the path of the chain.

A linear feed of a breech, with respect to the weapon barrel or cartridge chamber, is described in DE 10 2007 054 470.9, which was not published prior to the earliest priority date for the present application. In this case, a linear guide groove is integrated in the drive kinematics. A means, which is physically connected to the breech, is guided in the guide groove. The guide groove is itself surrounded by a circumferential positive guide (slotted link), which itself interprets the necessary times for the breech to be stationary during locking, firing and unlocking in its front position and during loading, once the breech has been moved to its rear position. An additional means is guided within the positive guide, as drive means for the breech. The drive transmission can be provided by sliding rollers, gear wheels, or the like, which are driven by a motor, etc. The drive itself continues to run during times in which the weapon is stationary, while the breech is moved out and back in again later during these stationary times.

Although the three last-mentioned solutions themselves already deal with practicable drives, which produce satisfactory results in terms of firing rate and mechanical wear, the present invention is based on the object of specifying an additional drive for a breech, such as disclosed below, which is likewise also used for higher firing rates.

SUMMARY OF THE INVENTION

The object of the present invention is achieved by the features of a drive (100) for a breech (3), or breech carrier (5), which can be moved in the axial direction with respect to a weapon barrel (1), having a motor (40) or the like, wherein the drive has the following additional features: a crank (8) provided with a groove (17), in which a crank pin (9) having at least one sliding means (10) and a guide block (11) fitted thereto, are introduced, is positively guided in at least one control cam (15), wherein the crank (8) is permanently rotated about a rotation axis (M), and the guide block (11) engages in a groove (16), which is arranged transversely with respect to the firing direction, in the breech carrier (5), such that the movements in the firing direction, which are predetermined by the control cam (15), are transmitted via crank pin (9) and breech carrier (5), and/or are transmitted directly to the breech (3), and movements transversely with respect to the firing direction result in relative movement of the guide block (11) of the crank pin (9) with respect to the groove (16) in the breech carrier (5) or breech (3). Advantageous additional embodiments are specified as follows.

In accordance with a second embodiment of the present invention, the first embodiment is modified so that the control cam (15) is integrated in the housing lower part (6) of a weapon or crank housing. In accordance with a third embodiment of the present invention, the second embodiment is further modified so that the control cam (15) is an open groove facing downward and upward. In accordance with a fourth embodiment of the present invention, the first embodiment, the second embodiment, and the third embodiment are further modified so that a further control cam (15) is integrated in the housing upper part (7) and is identical to that in the housing lower part (6), but in mirror-image form.

In accordance with a fifth embodiment of the present invention, the first embodiment, the second embodiment, the third embodiment and the fourth embodiment, are further modified so that the control cams (15) are defined by four different sectors or areas, by means of which the desired movement of the feed for the breech (3) is produced. In accordance with a sixth embodiment of the present invention, the fifth embodiment is further modified so that the shape of the control cam (15) corresponds to an "O" that has been pulled sideways on both vertical sides. In accordance with a seventh embodiment of the present invention, the first embodiment, the second embodiment, the third embodiment, the fourth embodiment, the fifth embodiment, and the sixth embodiment, are further modified so that the control cam (15) in the housing upper half (7) is an open groove that faces upward and in the direction of the housing lower half (6). In accordance with an eighth embodiment of the present invention, the first embodiment, the second embodiment, the third embodiment, the fourth embodiment, the fifth embodiment, and the sixth embodiment, are further modified so that a pair of, for example, eccentric gear wheels are located between the pinion shaft (14) and the motor (40) and rotate at twice the rotation speed of the crank (8).

The invention is based on the idea of providing a mechanism that has a low-level of breech acceleration and that operates smoothly and without jerking, thus decreasing the mass forces, reducing the drive power and allowing the firing rate to be increased. The reduction in the drive power furthermore results in a reduction in the braking power when rapid stopping is required.

An application filed in parallel by the same applicant has already described a further design solution. The principle of the application is that a crank drive is used to convert the rotary movement, preferably of a motor, or the like, to a forward and backward movement of the breech. In order to allow the breech to be stationary for times in the limit positions, a connecting rod and crank are arranged such that they can be moved radially with respect to one another, such that the crank radius changes with the rotation of the crank. The connecting rod is guided radially by a control cam, which is an intrinsically closed structure and that has defined areas as a movement profile for the breech.

A similar solution approach is also adopted here, with the principle of a Scotch-yoke crank drive being used to convert the rotary movement of a motor, etc., to a forward and backward movement of the breech, in a simple manner. In order to allow times during which the breech is stationary in the limit positions, the crank radius is predetermined by a control cam; however, this does not change with the rotation of the crank.

The shaft on which the crank rotates is driven externally, for example, via a pinion shaft, for example, via a motor. A crank pin is arranged such that it can move radially in a groove in the crank and, via a guide block, drives the breech carrier in a groove that runs transversely with respect to the filing direction. Two means, for example rollers, are arranged on the crank pin and run in control cams in the weapon or crank housing. The control cam is, in turn, subdivided into various sectors/areas, thus achieving the desired movement of the breech. In order to ensure that the breech is stationary for a specific time period when the crank is permanently rotated, specifically in its limit positions, the control cam is straight in these areas, while it is predetermined in the other areas on the basis of any required movement function, in order to optimize the acceleration, maximum speed, smoothness and freedom from impacts, etc., of the breech movement.

The Scotch-yoke crank drive has the advantage that low rotating masses (e.g., crank, motor and possibly step-up transmissions) are provided, which have to be braked in the event of rapid stopping. It has also been found to be a simple design.

DETAILED DESCRIPTION OF THE INVENTION

The invention will be explained in more detail using one at least exemplary embodiment and with reference to the drawings, and in which.

DETAILED DESCRIPTION OF THE INVENTION

Figure 1:
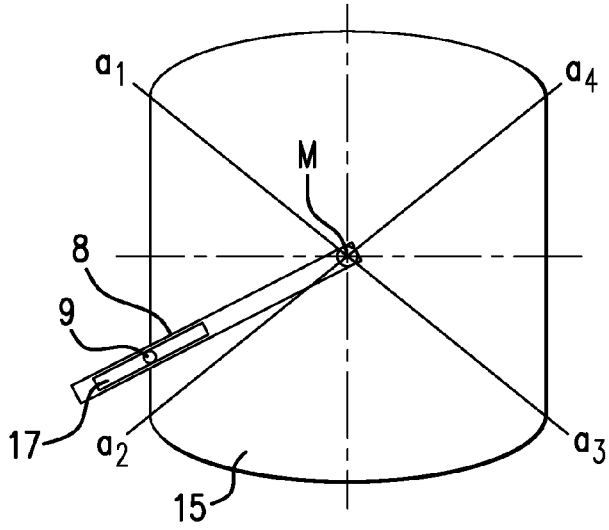
FIG. 1 shows a schematic view of a drive, in accordance with the present invention, provided with a preferred control cam.
Figure 2:
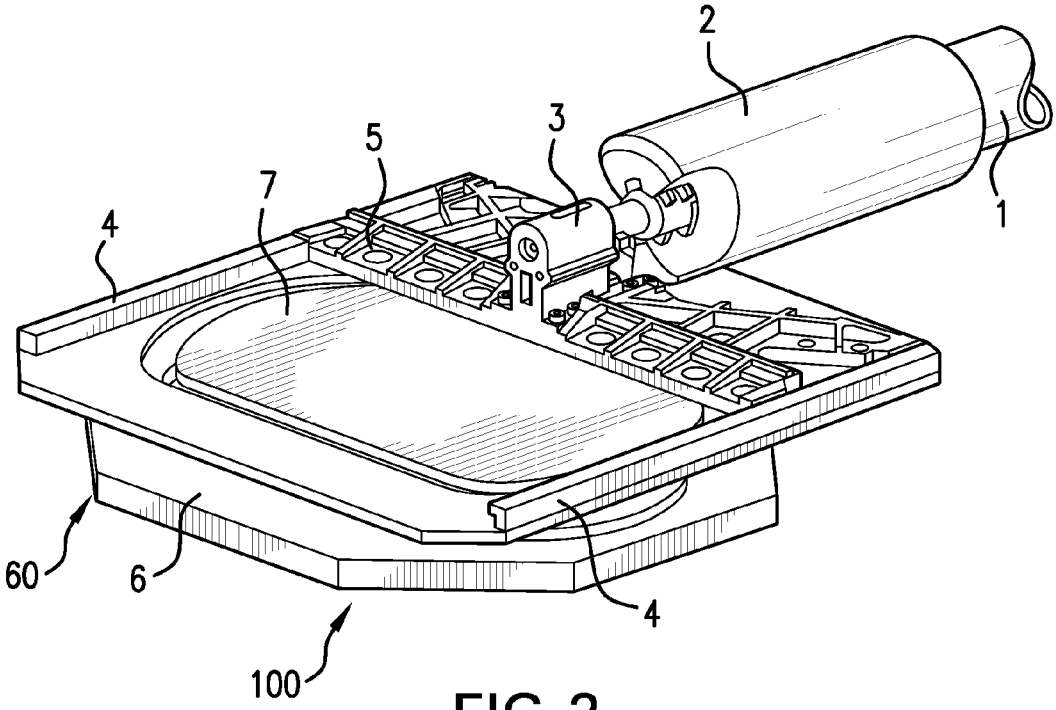
FIG. 2 shows a perspective view of a drive and breech provided with a weapon barrel, in accordance with the present invention, with the breech in a front position.

FIG. 1 schematically illustrates the method of operation and the fundamental principle for movement of a breech 3 in the direction of a weapon barrel 1 (See also FIG. 2). Drive kinematics 100, in general, consist primarily of a crank 8 provided with a groove formed therein, in which a crank pin 9 with, for example, two rollers 10*a*, 10*b* disposed thereon, is arranged and is guided positively by a control cam 15 (See FIGS. 3 and 4). The crank 8 is rotated about a rotation axis M, and is permanently rotated (i.e., may be continuously rotated as evident from FIG. 1).

The areas of the control cam 15 define the movement processes of the breech 3 into four sectors or areas as follows (See FIG. 1):

- $\alpha_1$-$\alpha_2$, (first sector or area), breech 3 positioned to the rear for waiting (i.e., first waiting position or rear position);
- $\alpha_2$-$\alpha_3$, (second sector or area), forward movement of the breech 3 in accordance with any desired function (i.e., first breech movement phase);
- $\alpha_3$-$\alpha_4$, (third sector or area), breech 3 positioned to the front for waiting (i.e., second waiting position, or front position);
- $\alpha_4$-$\alpha_1$, (fourth sector or area), rearward movement of the breech 3 in accordance with any desired function (i.e., second breech movement phase).

The movement profile of the breech 3, and the duration of the waiting times at the reversal positions of the breach 3 (e.g., first and fourth sectors), are predetermined by the shape of the control cam 15. In order to produce the required oscillating movement of the breech 3 with the waiting times at the reversal positions, the crank 8 is driven and caused to rotate continuously. The shape of the control cam 15 can be compared with an "O" that has been pulled sideways on two vertical sides, which may also be described as an "O" that has been pulled sideways with two linear sides, as shown in FIG. 2. Thus, the shape of the control cam 15 may be selected from the group consisting of a composite shape consisting of a rectangle with semi-circular ends, and shapes substantially similar to these shapes, and shapes approximately the same as these shapes, and the like.

FIG. 2 shows a design implementation of the fundamental principle of the breech drive, in accordance with the present invention. The weapon barrel 1 of a weapon is mounted in a barrel locking bush 2 (or a weapon housing), in which the breech 3 can also be locked in its front position (See FIG. 2). In this case, the breech 3 is arranged on a so-called breech carrier 5, which is in turn guided on breech guides 4. The breech 3 is mounted thereon such that it can move in the direction of the weapon barrel axis.

The drive kinematics 100 consist of an upper housing part 7 and a lower housing part 6, which are components of a weapon housing or crank housing. The weapon housing or crank housing are collectively referred to in the drawings by character reference 60. Each housing part 6, 7 has an identical control cam 15 (See FIG. 4), in which the rollers 10*a*, 10*b* run respectively. A duplicated form for the control cam 15 in each of the upper and lower housing parts 6, 7 was chosen in order to prevent tilting of the rollers 10*a*, 10*b* on the pin 9. It is self-evident that just one control cam is adequate, and may be used in accordance with the present invention, provided that this single control cam, and associated structures, and constructed to preclude the possibility of tilting.

Figure 3:
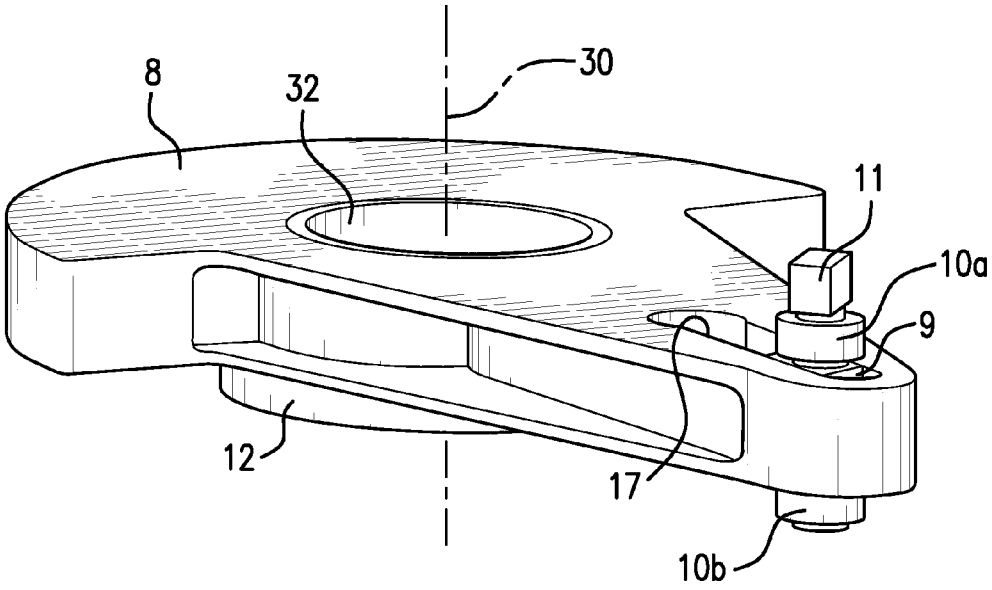
FIG. 3 shows an illustration of the crank, in accordance with the present invention.

FIG. 3 shows the crank 8 and the crank pin 9, with the two rollers 10*a*, 10*b* disposed thereon, and a guide block 11, which are shown in detail with surrounding structures removed for illustration purposes. The crank pin 9 is arranged such that it can move radially in the groove 17 in the crank 8 with respect to the axis of rotation 30 for the crank 8. A toothed ring 12 is preferably arranged at the bottom on the crank 8, via which the crank 8 can be driven.

Figure 4:
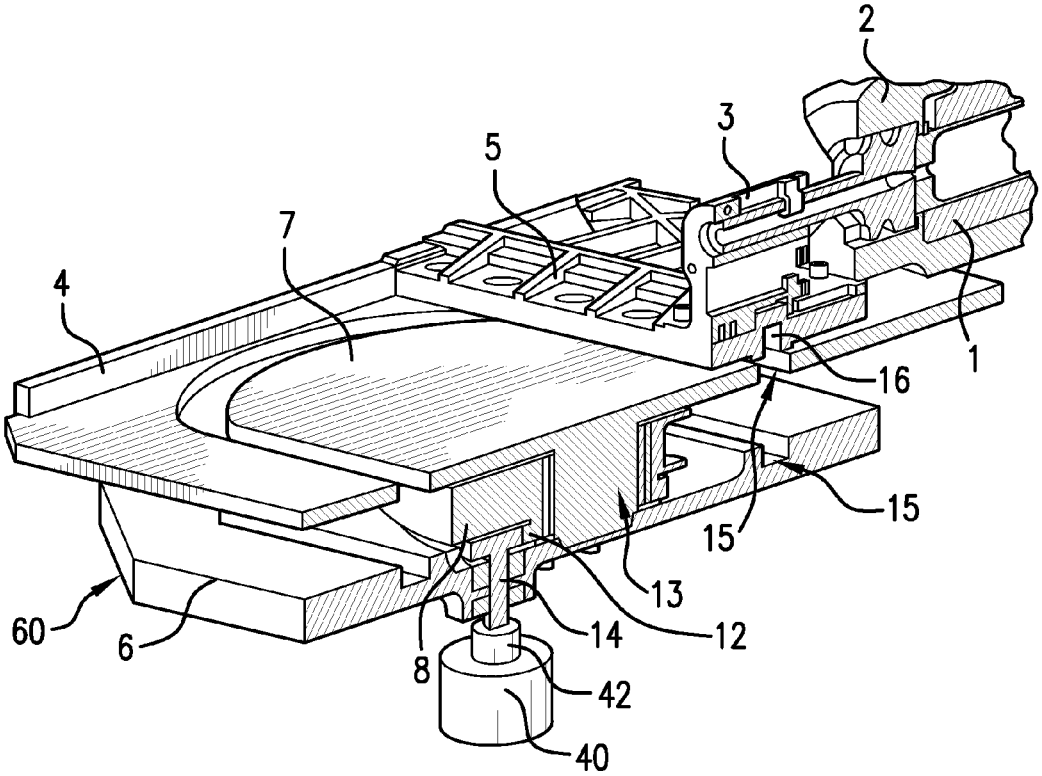
FIG. 4 shows a sectional illustration on the barrel center axis from FIG. 2.
Figure 5:
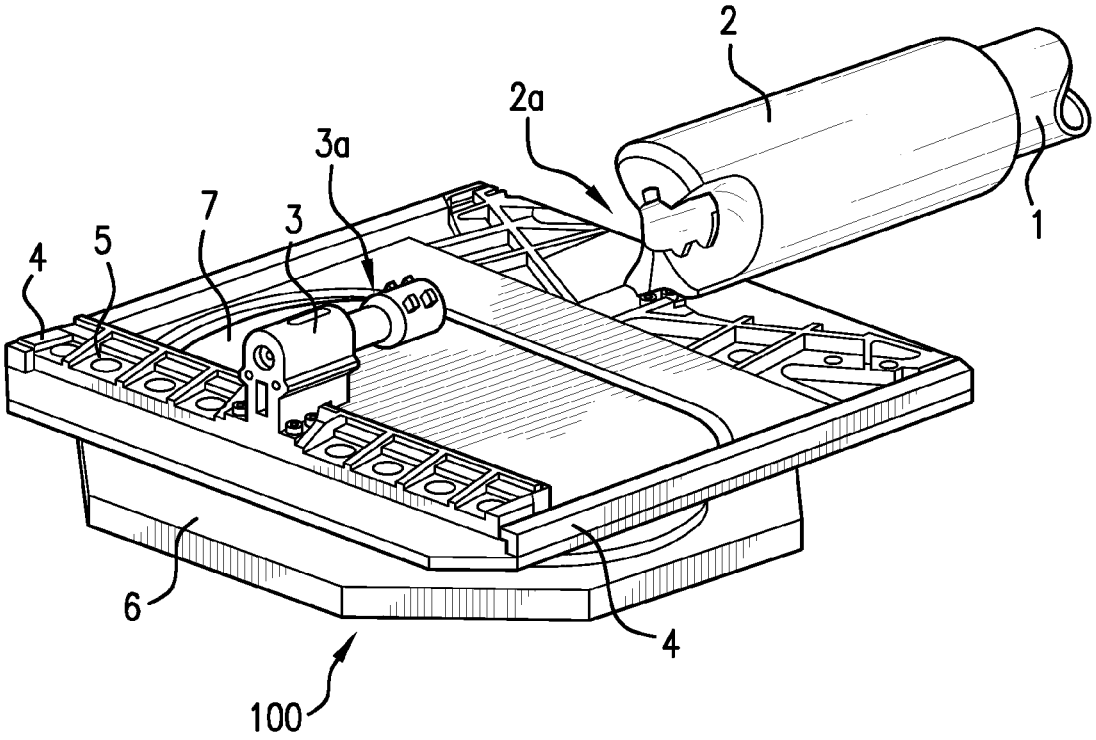
FIG. 5 shows a perspective view of the drive and breech provided with a weapon barrel, similar to FIG. 2 except that the breech is in the rear position.

FIG. 4 shows a perspective sectional view on the barrel axis according to FIG. 2, so that the arrangement of the crank 8 in the drive kinematics 100 can be seen. The end with the crank pin 9 is located on the side of the weapon, which is not illustrated in any more detail here. The crank 8 is mounted via hole 32 on a pin 13 on the housing upper part 7 such that the crank 8 can rotate, with the crank 8 being driven externally, for example, by a motor 40, via a pinion shaft 14 that engages the toothed ring 12. The crank 8 drives the crank pin 9 in the rotation direction. The rollers 10*a*, 10*b* in this case run in the two identical control cams 15 in the housing upper part 7 and in the housing lower part 6, and in doing so guide the crank pin 9. The guide block 11, which is mounted on the crank pin 9 at the top, engages in a groove 16 formed in the breech carrier 5, wherein the groove 16 is arranged transversely with respect to the firing direction, as evident from FIG. 4. In this way, movements in the firing direction, which are predetermined by the control cam 15, are transmitted via crank pin 9 and breech carrier 5 directly to the breech 3, while movements transversely with respect to the firing direction result in a relative movement of the guide block 11 of the guide pin 9 with respect to the groove 16 in the breech carrier 5. In other words, as the guide block 11 moves transversely with respect to the firing direction in the groove 16, while the crank pin 9 and its associated rollers 10*a*, 10*b* move in the corresponding control cams 15, the breech 3 is forced to move from the front position (See FIG. 2) to a rear position (See FIG. 5). When the breech is in the rear position, the socket 2*a* of the barrel locking bush 2 is separated from the catch head 3*a* of the breech 3 that otherwise may lock together when the breech 3 is in the front position. In FIG. 5, the space between the catch head 3*a* of the breech 3 and the socket 2*a* of the barrel locking bush 2 is provided so that an ammunition shell may be disposed into the direction of the weapon barrel 1 and locked in place when the breech 3 returns to the front position so that the catch head 3*a* (which has bumps) and the socket 2*a* engage and lock together (See FIG. 2).

An even more compact physical form for the control cam or cams 15 can be achieved by arranging a pair of, for example, eccentric, gearwheels (not illustrated in any more detail except schematically by a structure designated by character reference "42") between the pinion shaft 14 and the crank drive 40. To this end, the step-up ratio of the toothed ring 12 of the crank 8 to the pinion shaft 14 is selected for example such that the pinion 14 rotates at twice the rotation speed of the crank 8. Eccentric gearwheels result in a continuously varying step-up ratio, as a result of which, when the motor rotation speed is constant, the crank 8 rotates more slowly during the waiting time phases, and more quickly during the breech movement phases. The angle ranges $\alpha_1$ to $\alpha_2$ and $\alpha_3$ and $\alpha_4$ of the control cam or cams 6 can, therefore, be made smaller, without shortening the waiting times of the breech 3 in the front and rear positions.

The invention claimed is:

1. A drive operably connected to a breech carrier of a weapon, wherein a breech is moveable with the breech carrier in an axial direction with respect to a weapon barrel of the weapon, wherein the drive comprises (a) a motor;

(b) a crank operably connected to be driven by the motor, wherein the crank is provided with a first groove formed in the crank;

(c) a crank pin having at least one roller and a guide block fitted to the crank pin, wherein the crank pin is disposed in the first groove of the crank; and (d) a first control cam, wherein the crank pin is positively guided in the first control cam, wherein the crank is rotated about a rotation axis by the motor, and the guide block is disposed to engage in a second groove formed in the breech carrier, wherein the second groove is arranged transversely with respect to a firing direction of the weapon, so that movements of the breech in the firing direction are predetermined by the first control cam and are transmitted to the breech via the crank pin and the breech carrier, and movements of the crank pin transversely with respect to the firing direction result in relative movement of the guide block of the crank pin with respect to the second groove formed in the breech carrier.

2. The drive as claimed in claim 1, wherein the first control cam comprises four different sectors or areas, wherein these four different sectors or areas produce a desired movement of a feed for the breech.

3. The drive as claimed in claim 2, wherein the shape of the first control cam corresponds to an "O" shape that has been pulled sideways with two linear sides.

4. The drive as claimed in claim 3, wherein the "O" shape that has been pulled sideways with two linear sides corresponds to a composite shape consisting of a rectangle with semi-circular ends.

5. The drive as claimed in claim 1, wherein the crank is operably connected to be driven by the motor via a pinion shaft connected to the motor, and a pair of eccentric gear wheels are located between the pinion shaft and the motor, and rotate at twice the rotation speed of the crank.

6. The drive as claimed in claim 1, wherein the crank is continuously rotatable about the rotation axis by the motor.

7. The drive as claimed in claim 1, further comprising a second control cam integrated in a housing upper part of a weapon housing or of a crank housing of the weapon, wherein the second control cam is identical to the first control cam that is integrated in a housing lower part of the weapon housing or the crank housing, except that the second control cam is in mirror-image form with respect to the first control cam.

8. A drive operably connected to a breech carrier of a weapon, wherein a breech is moveable with the breech carrier in an axial direction with respect to a weapon barrel of the weapon, wherein the drive comprises (a) a motor;

(b) a crank operably connected to be driven by the motor, wherein the crank is provided with a first groove formed in the crank;

(c) a crank pin having at least one roller and a guide block fitted to the crank pin, wherein the crank pin is disposed in the first groove of the crank; and (d) a first control cam, wherein the crank pin is positively guided in the first control cam, wherein the crank is rotated about a rotation axis by the motor, and the guide block is disposed to engage in a second groove formed in the breech carrier, wherein the second groove is arranged transversely with respect to a firing direction of the weapon, so that movements of the breech in the firing direction are predetermined by the first control cam and are transmitted to the breech via the crank pin and the breech carrier, and movements of the crank pin transversely with respect to the firing direction result in relative movement of the guide block of the crank pin with respect to the second groove formed in the breech carrier, and wherein the first control cam is integrated in a housing lower part of a weapon housing or of a crank housing of the weapon.

9. The drive as claimed in claim 8, wherein the first control cam comprises an open groove facing upward integrated in the housing lower part.

10. The drive as claimed in claim 9, further comprising a second control cam integrated in a housing upper part of the weapon housing or of the crank housing, wherein the second control cam is identical to the first control cam in the housing lower part except that the second control cam is in mirror-image form with respect to the first control cam.

11. The drive as claimed in claim 10, wherein the second control cam integrated in the housing upper part comprises an open groove that faces in a direction of the housing lower part.

12. The drive as claimed in claim 10, wherein the first control cam and the second control cam each comprises four different sectors or areas, wherein these four different sectors or areas produce a desired movement of a feed for the breech.

13. The drive as claimed in claim 12, wherein the shape of the first control cam and the shape of the second control cam corresponds to an "O" shape that has been pulled sideways with two linear sides.

14. The drive as claimed in claim 9, wherein the first control cam comprises four different sectors or areas, wherein these four different sectors or areas produce a desired movement of a feed for the breech.

15. The drive as claimed in claim 14, wherein the shape of the first control cam corresponds to an "O" shape that has been pulled sideways with two linear sides.

16. The drive as claimed in claim 8, further comprising a second control cam integrated in a housing upper part of the weapon housing or of the crank housing, wherein the second control cam is identical to the first control cam in the housing lower part except that the second control cam is in mirror-image form with respect to the first control cam.

17. The drive as claimed in claim 8, wherein the first control cam comprises four different sectors or areas, wherein these four different sectors or areas produce a desired movement of a feed for the breech.

18. The drive as claimed in claim 17, wherein the shape of the first control cam corresponds to an "O" shape that has been pulled sideways with two linear sides.

19. A drive operably connected to a breech of a weapon, wherein the breech is moveable in an axial direction with respect to a weapon barrel of the weapon, wherein the drive comprises (a) a motor;

(b) a crank operably connected to be driven by the motor, wherein the crank is provided with a first groove formed in the crank;

(c) a crank pin having at least one roller and a guide block fitted to the crank pin, wherein the crank pin is disposed in the first groove of the crank; and (d) a first control cam, wherein the crank pin is positively guided in the first control cam, wherein the crank is rotated about a rotation axis by the motor, and the guide block is disposed to engage in a second groove formed in the breech, wherein the second groove is arranged transversely with respect to a firing direction of the weapon, so that movements of the breech in the firing direction are predetermined by the first control cam and are transmitted directly to the breech, and movements of the crank pin transversely with respect to the firing direction result in relative movement of the guide block of the crank pin with respect to the second groove formed in the breech.

20. A drive operably connected to a breech of a weapon, wherein the breech is moveable in an axial direction with respect to a weapon barrel of the weapon, wherein the drive comprises (a) a motor;

(b) a crank operably connected to be driven by the motor, wherein the crank is provided with a first groove formed in the crank;

(c) a crank pin having at least one roller and a guide block fitted to the crank pin, wherein the crank pin is disposed in the first groove of the crank; and (d) a first control cam, wherein the crank pin is positively guided in the first control cam, wherein the crank is rotated about a rotation axis by the motor, and the guide block is disposed to engage in a second groove formed in the breech, wherein the second groove is arranged transversely with respect to a firing direction of the weapon, so that movements of the breech in the firing direction are predetermined by the first control cam and are transmitted directly to the breech, and movements of the crank pin transversely with respect to the firing direction result in relative movement of the guide block of the crank pin with respect to the second groove formed in the breech, and wherein the first control cam is integrated in a housing lower part of a weapon housing or of a crank housing of the weapon.

* * * * *